US009522473B2

(12) United States Patent
Mascari et al.

(10) Patent No.: US 9,522,473 B2
(45) Date of Patent: Dec. 20, 2016

(54) MOVEABLE LUBRICATION ASSEMBLY FOR POWER OPERATED ROTARY KNIFE

(71) Applicant: Bettcher Industries, Inc., Birmingham, OH (US)

(72) Inventors: Nicholas A. Mascari, Wellington, OH (US); Kenneth E. Carper, Cincinnati, OH (US)

(73) Assignee: Bettcher Industries, Inc., Birmingham, OH (US)

( * ) Notice: Subject to any disclaimer, the term of this patent is extended or adjusted under 35 U.S.C. 154(b) by 174 days.

(21) Appl. No.: 14/205,662

(22) Filed: Mar. 12, 2014

(65) Prior Publication Data

US 2014/0259690 A1 Sep. 18, 2014

Related U.S. Application Data

(60) Provisional application No. 61/784,545, filed on Mar. 14, 2013.

(51) Int. Cl.
*B26B 25/00* (2006.01)
*B26D 7/08* (2006.01)

(52) U.S. Cl.
CPC ..... *B26B 25/002* (2013.01); *B26D 7/088* (2013.01); *Y10T 137/0318* (2015.04)

(58) Field of Classification Search
CPC ..... B26B 25/002
(Continued)

(56) References Cited

U.S. PATENT DOCUMENTS 4,324,043 A * 4/1982 McCullough ..... B26B 25/002 30/276
4,439,924 A * 4/1984 Bettcher ..... B26B 25/002 30/276

(Continued)

FOREIGN PATENT DOCUMENTS

WO WO 2014160043 A1 * 10/2014
WO WO 2014164324 A1 * 10/2014

OTHER PUBLICATIONS

International Search Report and Written Opinion of the International Searching Authority dated Jul. 18, 2014 for PCT International Application No. PCT/US2014/025694, PCT International Filing Date Mar. 13, 2014. PCT International Application No. PCT/US2014/025694, corresponds to and claims priority from the present application. (10 pages).

*Primary Examiner* — Jason Daniel Prone
(74) *Attorney, Agent, or Firm* — Tarolli, Sundheim, Covell & Tummino LLP

(57) ABSTRACT

A power operated rotary knife (100) and method of operation includes an annular rotary blade (380). The knife further comprises a head assembly (300) extending from a handle assembly (200), the head assembly for rotatably supporting the annular rotary blade. The knife also includes a drive mechanism (600) disposed within the head assembly comprising a pinion gear (604) and a pinion shaft (970) rotatably disposed within a bushing (610), the drive mechanism being operatively coupled to the annular rotary blade, rotating the annular blade during use. A movable lubrication assembly (900) supported along a frame body between the handle assembly and the annular rotary blade, the rotatable lubrication assembly being rotatably disposed about a longitudinal axis of the handle assembly and providing a lubrication path (1000) extending from a lubrication adapter (924) to the pinion gear (604).

19 Claims, 18 Drawing Sheets

(58) Field of Classification Search
USPC ..... 30/276
See application file for complete search history.

(56) References Cited

U.S. PATENT DOCUMENTS 4,494,311 A 1/1985 McCullough
4,516,323 A * 5/1985 Bettcher ..... B26B 25/002 30/276
4,854,046 A * 8/1989 Decker ..... B26B 25/002 30/276
4,894,915 A * 1/1990 Decker ..... B26B 25/002 30/276
4,993,112 A * 2/1991 Burnett ..... A22C 17/12 30/276
5,031,323 A * 7/1991 Honsa ..... B25F 5/021 30/276
5,035,055 A * 7/1991 McCullough ..... B26B 25/002 30/276
5,084,976 A * 2/1992 Ross ..... B26B 25/002 30/276
5,230,154 A 7/1993 Decker et al.
5,761,817 A * 6/1998 Whited ..... B26B 25/002 30/276
6,354,949 B1 * 3/2002 Baris ..... B26B 25/002 464/176
6,604,288 B2 * 8/2003 Whited ..... B26B 25/002 30/276
6,662,452 B2 * 12/2003 Whited ..... B26B 25/002 30/276
6,751,872 B1 6/2004 Whited et al.
6,769,184 B1 8/2004 Whited
8,448,340 B2 * 5/2013 Whited ..... B26B 25/002 30/276
8,505,207 B2 * 8/2013 Thien ..... B26B 7/00 30/276
8,661,692 B2 * 3/2014 Whited ..... B26B 25/002 30/276
8,695,222 B2 * 4/2014 Whited ..... B26B 25/002 30/267
8,726,524 B2 * 5/2014 Whited ..... B26B 25/002 30/276
8,739,416 B2 * 6/2014 Mascari ..... B26B 25/002 30/276
8,745,881 B2 * 6/2014 Thompson ..... B26B 25/002 30/276
8,806,761 B2 * 8/2014 Whited ..... B26B 25/002 30/276
8,950,076 B2 * 2/2015 Whited ..... B26B 25/002 30/276
9,121,438 B2 * 9/2015 Mascari ..... B26B 25/002 30/276
9,211,650 B2 * 12/2015 Mascari ..... B26B 25/002 30/276
9,265,263 B2 * 2/2016 Whited ..... B26B 25/002 30/276
2004/0187316 A1 9/2004 Whited et al.
2005/0217119 A1 * 10/2005 Rapp ..... B26B 25/002 30/276
2007/0078012 A1 * 4/2007 Rosu ..... F16C 1/06 464/52
2011/0185580 A1 8/2011 Whited
2012/0011980 A1 * 1/2012 Kroger ..... B26B 25/002 83/698.41
2013/0056324 A1 * 3/2013 Freund ..... B26B 25/002 192/69
2014/0250697 A1 * 9/2014 Steele ..... B26B 25/002 30/275.4
2016/0082612 A1 * 3/2016 Mascari ..... B26B 25/002 30/276

* cited by examiner

MOVEABLE LUBRICATION ASSEMBLY FOR POWER OPERATED ROTARY KNIFE

CROSS REFERENCE TO RELATED APPLICATION

The present application is a non-provisional application that claims priority to U.S. Provisional Application Ser. No. 61/784,545 under 35 U.S.C. §119(e) entitled MOVEABLE LUBRICATION ASSEMBLY FOR POWER OPERATED ROTARY KNIFE, which was filed on Mar. 14, 2013 with the United States Patent Office. The present application claims priority to said provisional application, which is incorporated by reference in its entirety herein for all purposes.

TECHNICAL FIELD

The present disclosure relates to a moveable lubrication assembly for a power operated rotary knife, and more specifically, a moveable lubrication assembly that includes rotatably positioned lubrication cup arrangement.

BACKGROUND

Power operated rotary knives are widely used in meat processing facilities for meat cutting and trimming operations. Power operated rotary knives also have application in a variety of other industries where cutting and/or trimming operations need to be performed quickly and with less effort than would be the case if traditional manual cutting or trimming tools were used, e.g., long knives, scissors, nippers, etc. By way of example, power operated rotary knives may be effectively utilized for such diverse tasks as taxidermy; cutting and trimming of elastomeric or urethane foam for a variety of applications, including vehicle seats; and tissue removal or debriding in connection with medical/surgical procedures and/or tissue recovery from a body of a human or animal donor.

Power operated rotary knives typically include a head assembly and a handle assembly. The handle assembly includes an elongated central core and a hand piece mounted on the elongated central core. The hand piece includes a gripping surface to be grasped by an operator or user to manipulate the power operated rotary knife. The elongated central core includes a distal end attachment structure for releasably securing the handle assembly to the head assembly.

The head assembly includes a rotary knife blade, a blade housing for rotatably supporting the rotary knife blade and a frame body. At a proximal end, the frame body includes a mating attachment structure that receives the distal end attachment structure of the handle assembly to releasably secure the handle and head assemblies. At a distal end, the frame body includes a mounting pedestal for detachably mounting the blade housing. The frame body also defines a cavity to support a gear train for rotatably driving the rotary knife blade. The frame member supports the hand grip which is grasped by an operator and used to manipulate the power operated rotary knife.

Further discussion of power operated rotary knives is found in U.S. Pat. No. 5,230,154 to Decker et al. and U.S. Pat. No. 5,400,511 to Decker, both assigned to the assignee of the present application. Both U.S. Pat. No. 5,230,154 to Decker et al. and U.S. Pat. No. 5,400,511 to Decker are incorporated herein in their respective entireties by reference.

SUMMARY

In one aspect, the present disclosure relates to a power operated rotary knife and method of operation having an annular rotary blade. The knife further comprises a head assembly extending from a handle assembly, the head assembly for rotatably supporting the annular rotary blade. The knife also includes a drive mechanism disposed within the head assembly comprising a pinion gear and a pinion shaft rotatably disposed within a bushing, the drive mechanism being operatively coupled to the annular rotary blade, rotating the annular blade during use. A movable lubrication assembly is supported along a frame body between the handle assembly and the annular rotary blade, the rotatable lubrication assembly is rotatably disposed about a longitudinal axis of the handle assembly and providing a lubrication path extending from a lubrication adapter to the pinion gear.

In another aspect, the present disclosure relates to a method of providing lubrication to a power operated rotary knife comprising the steps of extending a head assembly from a handle assembly, the head assembly for rotatably supporting an annular rotary blade. The method further comprises the step of rotating the annular rotary blade with a drive mechanism comprising a pinion gear and pinion shaft; and lubricating the drive mechanism by providing a moveable lubrication assembly supported along a frame body between the handle assembly and the annular rotary blade.

In yet another aspect, the present disclosure relates to a power operated rotary knife comprising a head assembly extending from a handle assembly, the head assembly for rotatably supporting an annular rotary blade, a drive mechanism being operatively engaged to the annular rotary blade, and a moveable lubrication assembly freely rotatable about the handle assembly and the head assembly, the moveable lubrication assembly providing as needed during use lubrication to the drive mechanism independent of location.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

DETAILED DESCRIPTION

Figure 1:
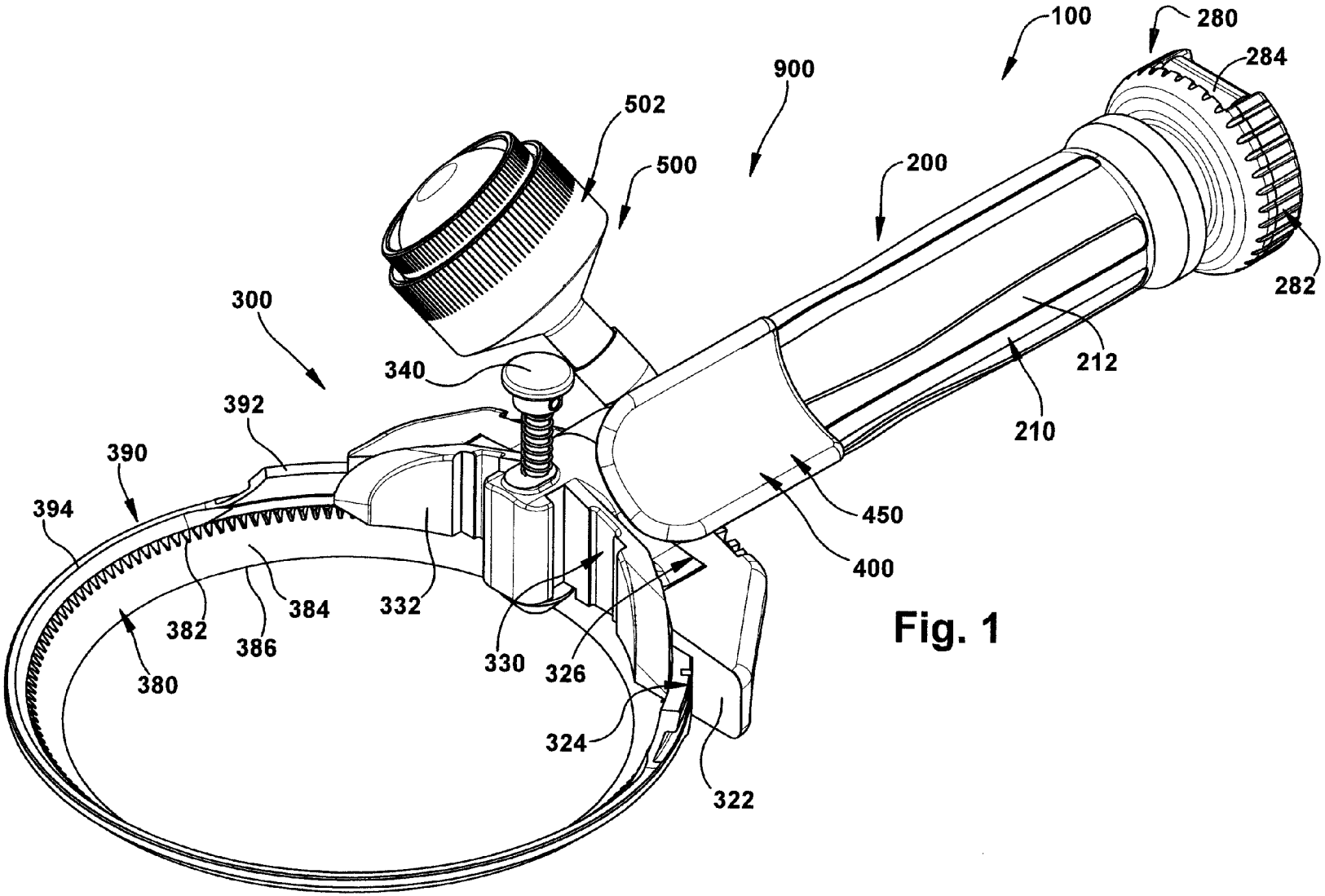
FIG. 1 is a schematic top front perspective view of a power operated rotary knife.
Figure 2:
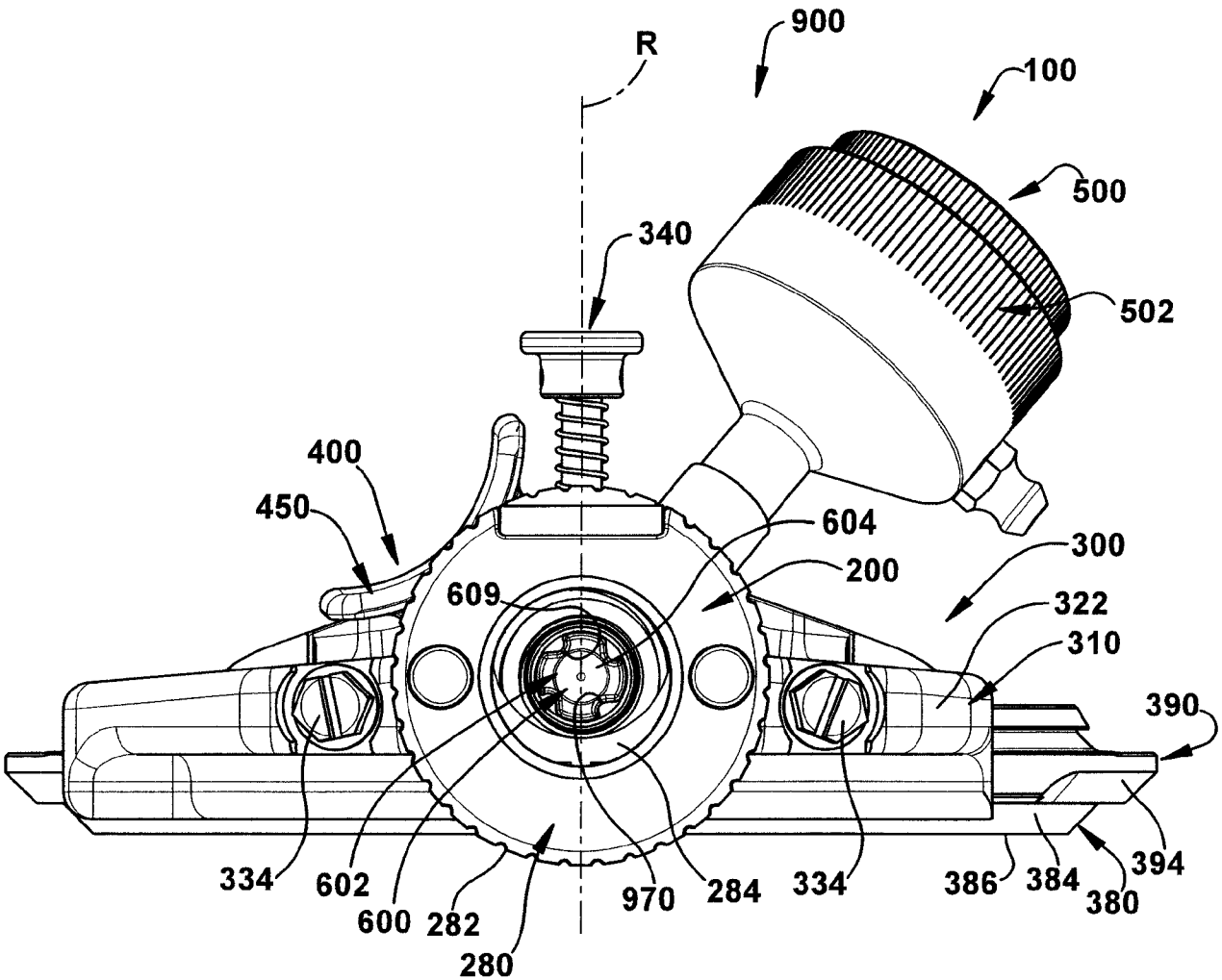
FIG. 2 is a schematic rear elevation view of the power operated rotary knife of FIG. 1.
Figure 3:
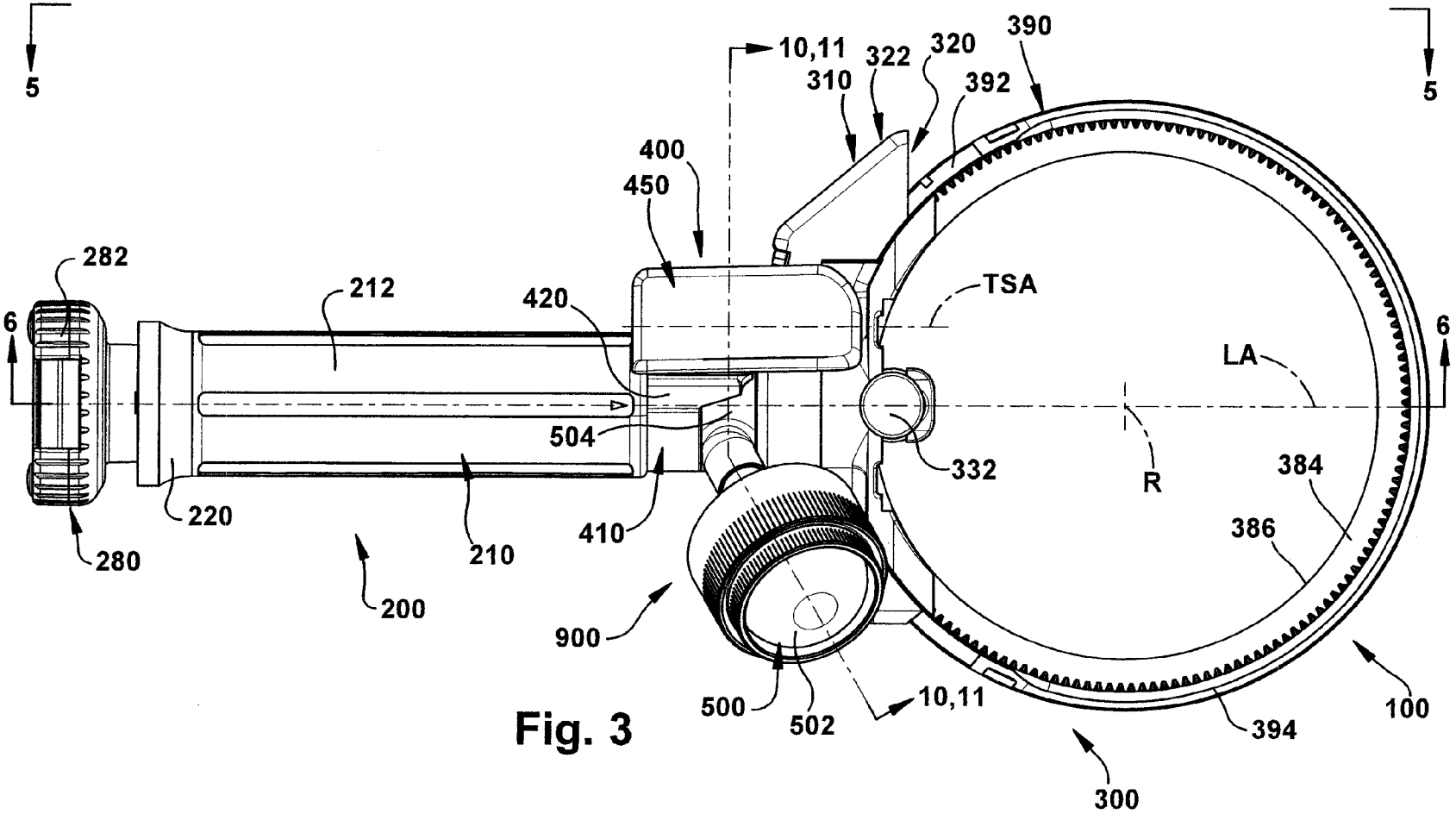
FIG. 3 is a schematic top plan view of the power operated rotary knife of FIG. 1.
Figure 4:
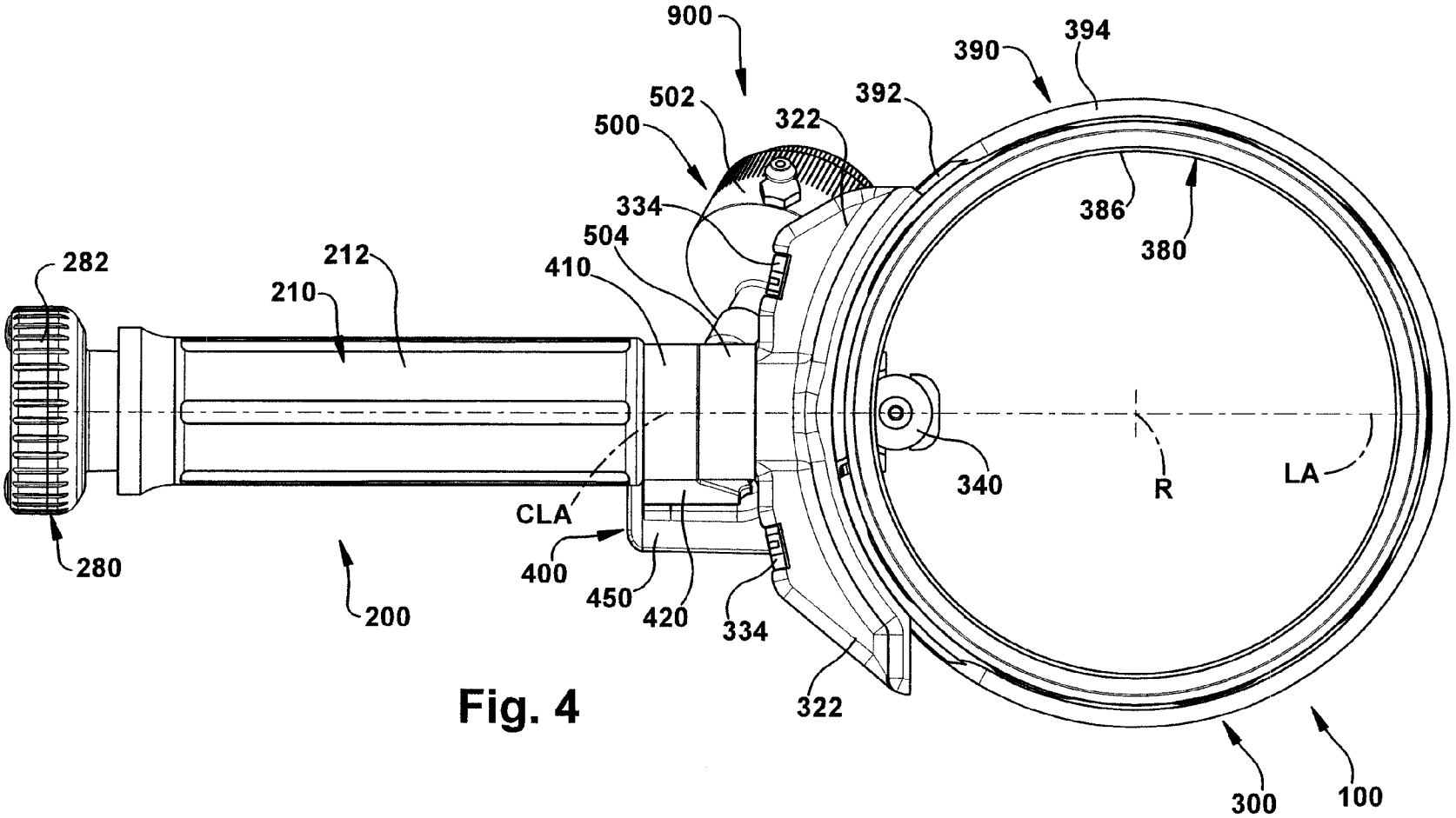
FIG. 4 is a schematic bottom plan view of the power operated rotary knife of FIG. 1.
Figure 5:
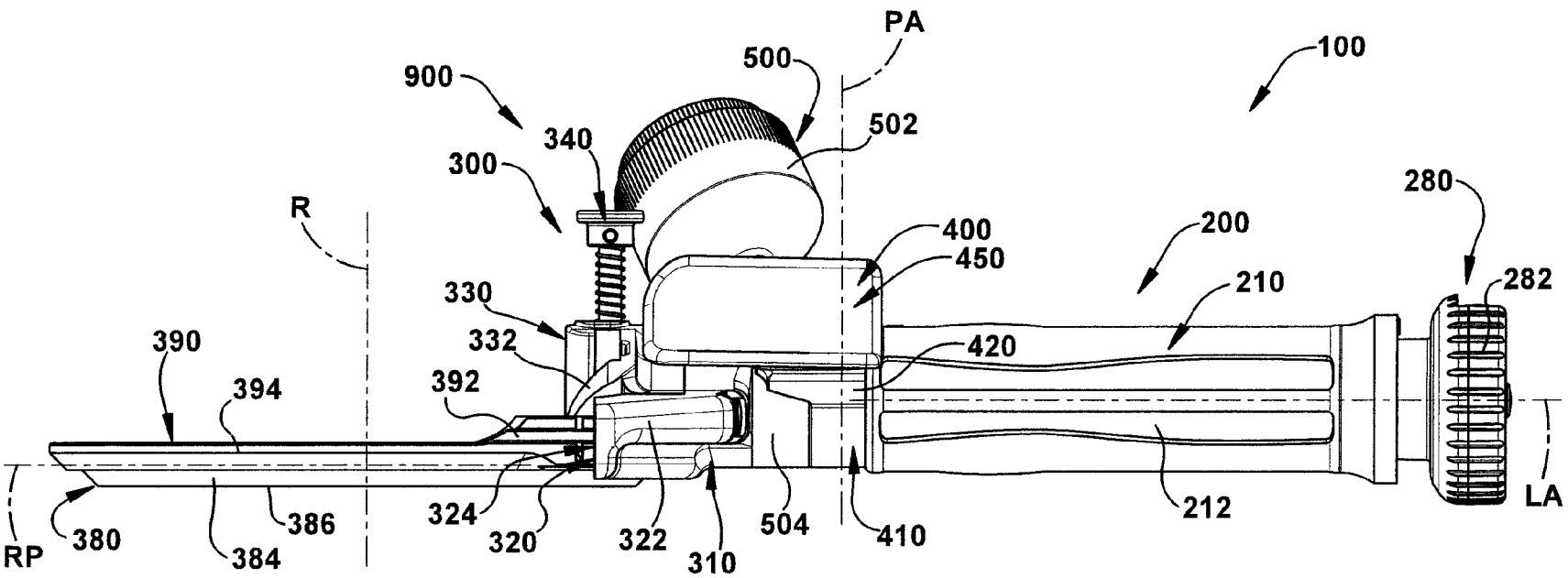
FIG. 5 is a schematic side elevation view of the power operated rotary knife of FIG. 1 as seen from a plane indicated by the line 5-5 in FIG. 3.

Referring now to the figures generally wherein like numbered features shown therein refer to like elements having similar characteristics and operational properties throughout unless otherwise noted. The present disclosure relates to a moveable lubrication assembly for a power operated rotary knife, and more specifically, a moveable lubrication assembly that includes rotatably disposed lubrication cup arrangement.

The power operated rotary knife's moveable lubrication assembly that includes a rotatably disposed lubrication cup arrangement are advantageously rotated with respect to a stationary handle position to provide a plurality of hand/operator orientations, including orientations suitable for left-handed and right-handed use of the power operated rotary knife, without the need for disassembly of the power operated rotary knife. In the illustrated example embodiment that includes a thumb support, the lubrication assembly is capable of endless rotation upon retraction of the thumb support.

Referring now to the drawings, FIGS. 1-8 and 17-19 schematically illustrate an exemplary embodiment of a power operated rotary knife 100 of the present disclosure. The power operated rotary knife 100 includes a handle assembly 200 and a head assembly 300 releasably affixed to the handle assembly. The power operated rotary knife 100 includes a moveable lubrication assembly 900 (best seen in FIGS. 9-16) of the present disclosure rotatably disposed on a portion the head assembly 300.

The moveable lubrication assembly 900 comprises lubrication cup arrangement 500 and seals 506. The lubrication cup arrangement includes a lubrication cup 502 and an annular support 504. In one example embodiment, the lubrication assembly 900 receives a lubricant, such as a food-grade grease (approved by the FDA), but is also capable of receiving other types of lubrication without departing from the spirit and scope of the present disclosure. Other types of suitable lubrication in addition to food-grade grease include, but are not limited to, bearing grease, water-based greases, silicon-based lubricants, water-soluble greases, oils, and the like.

Head Assembly 300

As can best be seen in FIGS. 1, 3, 7 and 8, the head assembly 300 includes a frame housing or frame body 310, a clamping assembly 330, a blade housing 390 and a rotary knife blade 380. The rotary knife blade 380 is supported for rotation about an axis of rotation R (FIGS. 2, 5 and 6) by the blade housing 390. The blade housing 390 defines a rotational plane RP (FIGS. 5 and 6) of the rotary knife blade 380. The blade housing 390, in turn, is releasably affixed to the frame body 310 by a clamp 332 of the clamp assembly 330.

Figure 6:
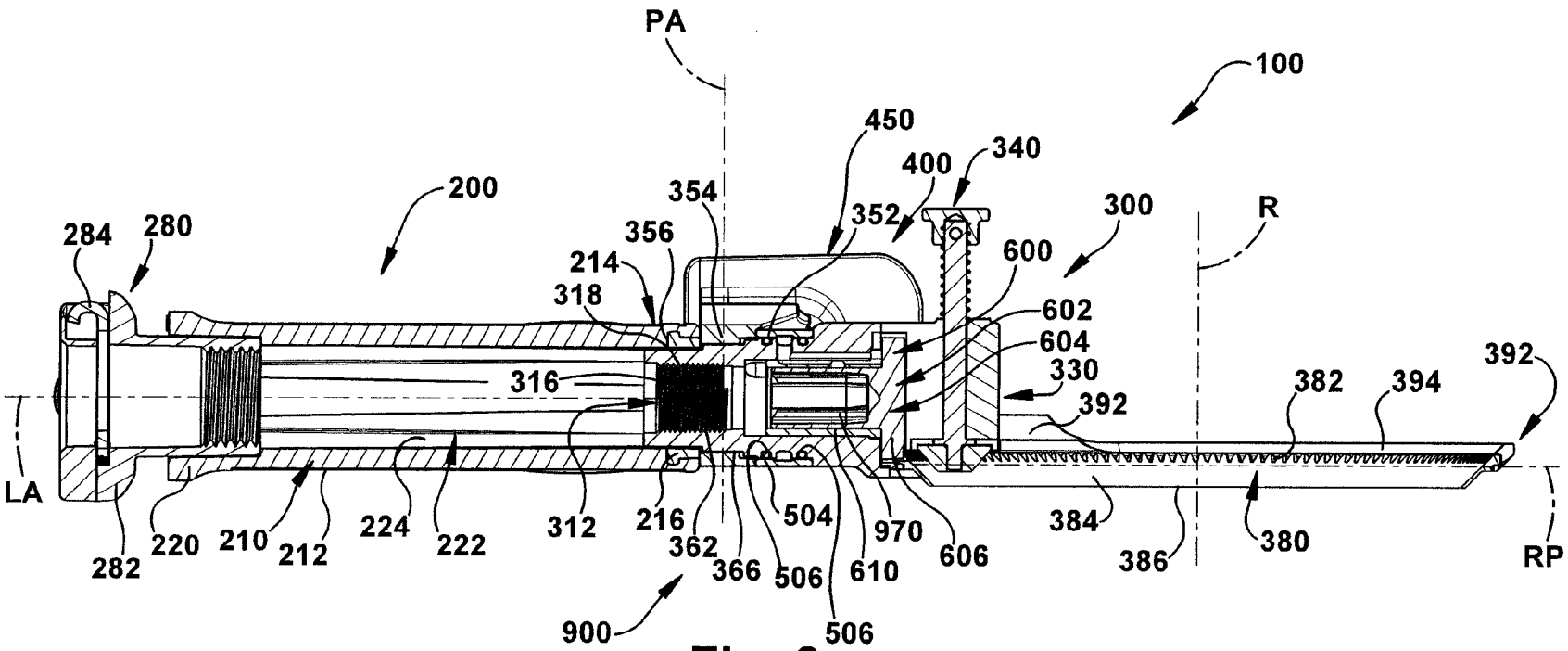
FIG. 6 is a schematic longitudinal section view of the power operated rotary knife of FIG. 1 as seen from a plane indicated by the line 6-6 in FIG. 3.
Figure 7:
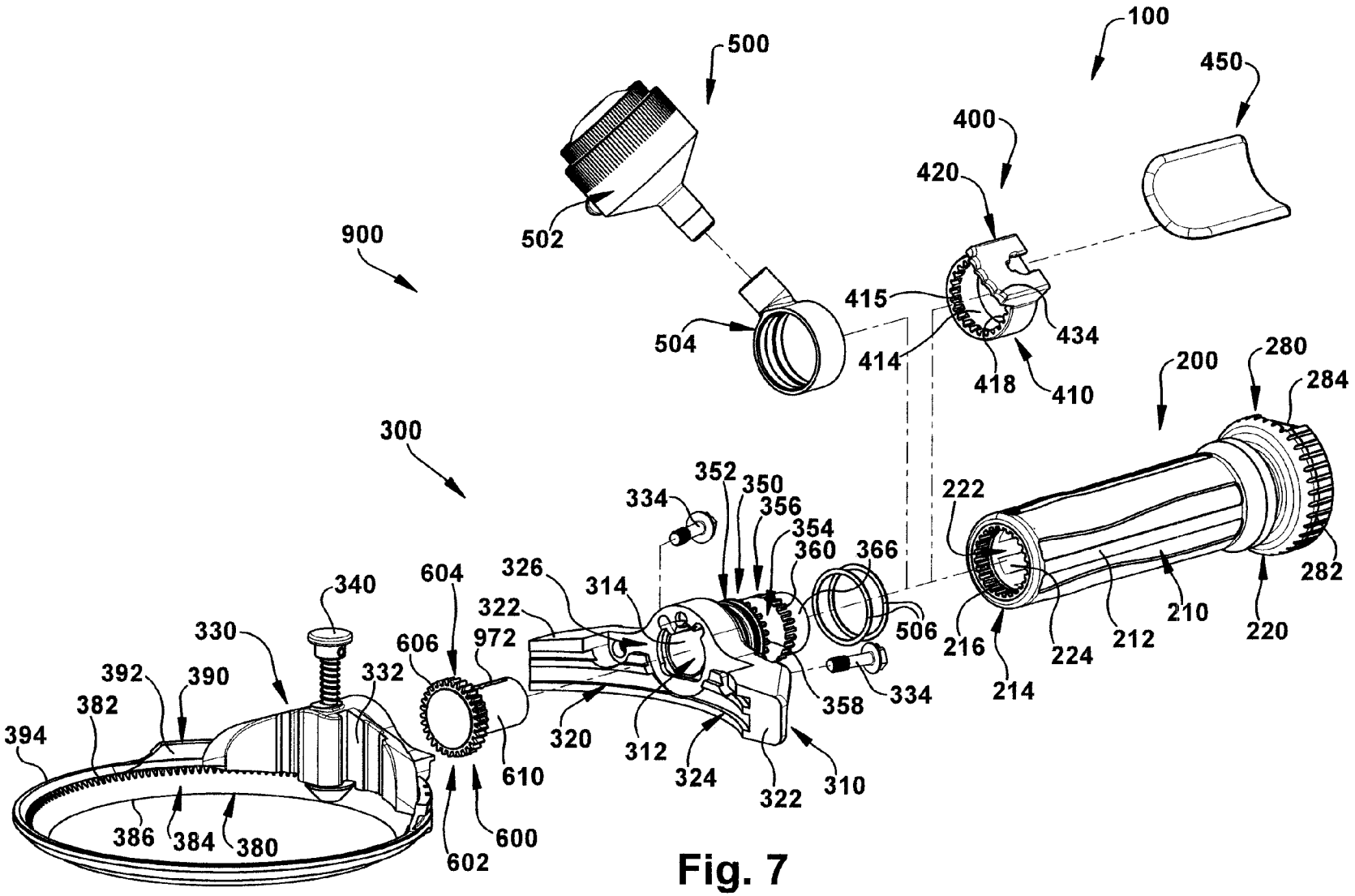
FIG. 7 is a schematic exploded front perspective view of the power operated rotary knife of FIG. 1.
Figure 8:
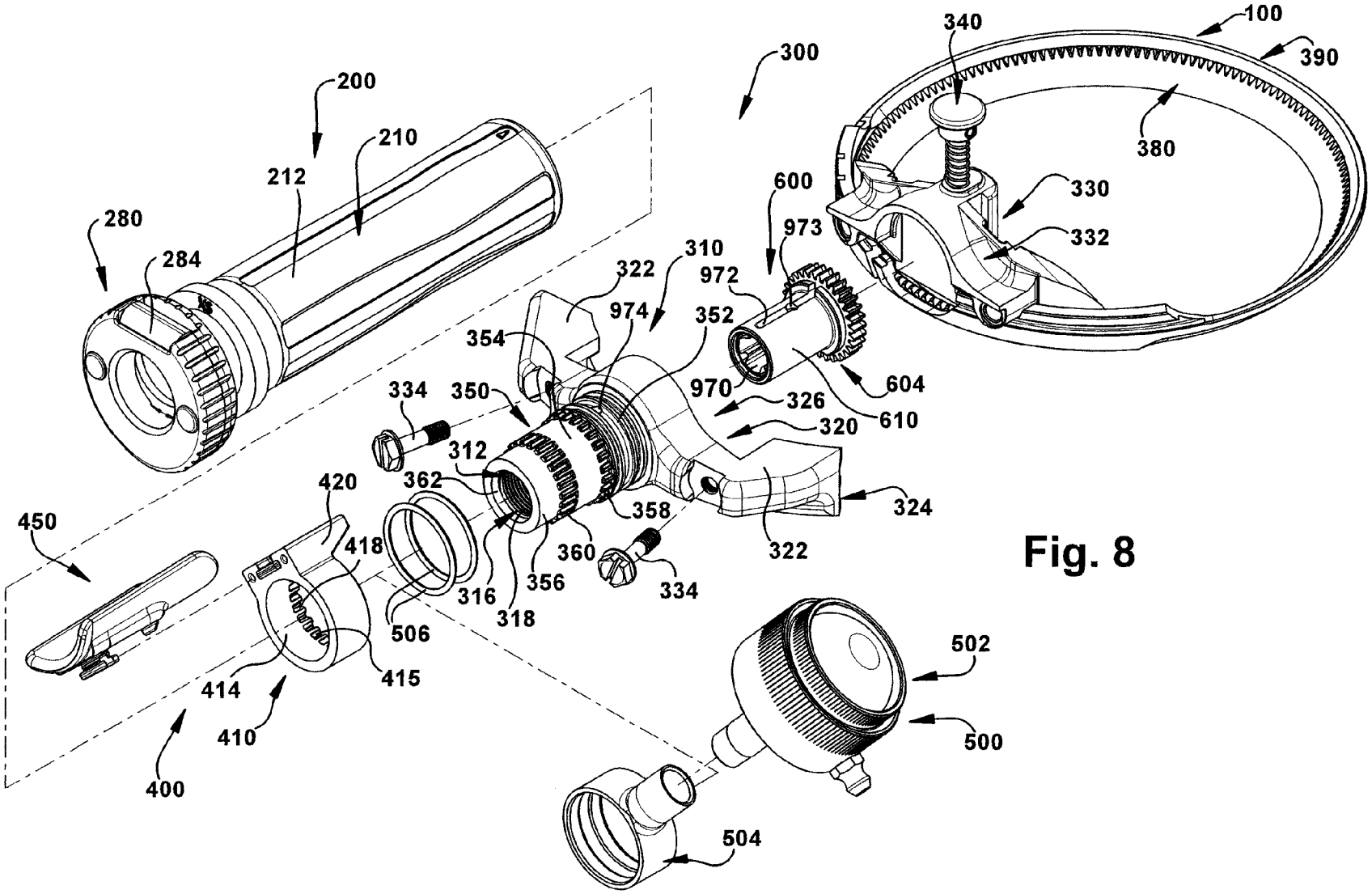
FIG. 8 is a schematic exploded rear perspective view of the power operated rotary knife of FIG. 1.

As is best seen in FIGS. 6-8, the frame body 310 also supports a drive mechanism 600 of the power operated rotary knife 100. In one exemplary embodiment, the frame body 310 includes a longitudinally extending, central throughbore 312, which supports a gear train 602 of the drive mechanism 600. Specifically, the gear train 602 includes a pinion gear 604 and an input shaft 970 of the pinion gear 604 is supported for rotation within a cylindrical bushing 610 positioned within a front portion 314 of the throughbore 312. The pinion gear 604 is precisely positioned and oriented by the frame body 310 such that a gear head 606 of the pinion gear meshes with a set of gear teeth 382 of the rotary knife blade 380 to rotate the knife blade 380 within the blade housing 390.

Frame Body 310

The frame body 310 includes a forward or distal blade housing support region 320 and a rearward annular boss 350. The forward blade support region 320 includes a pair of outwardly extending arcuate arms 322 which define a blade housing mounting region 324 for receiving an arcuate mounting section 392 of the blade housing 390 and a clamping receiving region 326 for receiving the proximal wall of the clamp 332 of the clamping assembly 330. The clamp 332 is secured to the frame body 310 by a pair a threaded fasteners 334 that extend through respective openings in the arcuate arms 322 of the frame body 310. The arcuate mounting section 392 of the blade housing 390 is sandwiched between the forward blade housing support region 320 and the clamp 332 to releasably secure the blade housing 390 to the frame body 310. The clamp assembly 330 further includes a steeling assembly 340 which may be depressed by the operator during operation of the power operated rotary knife 100 for steeling the rotary knife blade 380.

In one exemplary embodiment, the rearward annular boss 350 of the frame body 310 includes an inner surface 362 defining a rear portion 316 of the central throughbore 312. The rear portion 316 of the central throughbore includes a threaded section 318. A frame tube (not shown) threads into and is permanently affixed to the threaded section 318 of the rearward annular boss 350. The frame tube (not shown) extends rearwardly though a central throughbore 222 of a hand piece 210 of the handle assembly 300 and includes a threaded proximal end section.

Handle Assembly 200

As can best be seen in FIGS. 1 and 3-6, the handle assembly 200 extends along a longitudinal axis LA. The handle assembly 200 includes a hand piece 210 defining an exterior gripping surface 212 adapted to be gripped by an operator of the power operated knife 100 when wielding and manipulating the knife 100. The hand piece 210 includes a central throughbore 222 (FIG. 6) defined by an inner surface 224 of the hand piece 210. The throughbore 222 is coaxial with the longitudinal axis LA and is aligned with the frame body throughbore 312.

The handle assembly 200 further includes a drive shaft latching assembly 280. The shaft drive latching assembly 280 releasably secures a flexible shaft drive assembly (not shown) of the drive mechanism 600 to the handle assembly 200 such that motive power may be applied to rotate the pinion gear 604 within the throughbore 312 of the frame body 310 and thereby rotate the rotary knife blade 380. The shaft drive latching assembly 280 includes a latching knob 282 secured to a proximal end 220 of the hand piece 210 and a latching member 284 for releasably securing a coupling of the shaft drive assembly to the handle assembly 200.

The latching knob 282 of the drive shaft latching assembly 280 threads onto the threaded end section (not shown) of the frame tube (not shown) of the frame body 310. When the latching knob 282 is threaded onto the threaded proximal end section of the frame tube, the hand piece 210 is thereby sandwiched and secured to the rearward annular boss 350 of the frame body 310.

Rotary Knife Blade 380 and Blade Housing 390

The rotary knife blade 380 of the power operated rotary knife 100 includes the set gear teeth 382 at one axial end of the blade 380 and a blade section 384 at an opposite axial end of the blade 380. The blade section terminates at a lower end at a cutting edge 384. The blade housing 390 includes an annular blade support section 394 that support the rotary knife blade 380 for rotation about the central axis of rotation R and defines the rotational plane RP of the blade, which is substantially orthogonal to the axis of rotation R.

Drive Mechanism 600

The drive mechanism 600 of the power operated rotary knife 100 includes a gear train 602 supported within the central throughbore 312 of the frame body 310. In one exemplary embodiment, the gear train 602 includes the pinion gear 604. The input shaft 970 of the pinion gear 604 is supported for rotation by the cylindrical bushing 610 positioned within the front portion 314 of the throughbore 312, as further illustrated in FIG. 9B. A drive coupling of a flexible shaft drive transmission (not shown) extends through the throughbore 222 of the hand piece 210 of the handle assembly and engages a female coupling 609 (FIG. 2) defined by the pinion gear input shaft 970 to rotate the pinion gear 604. The gear head 606 of the pinion gear 604 operatively engages the set of gear teeth 382 of the rotary knife blade 380 to rotate the knife blade 380 within the blade housing 390.

Thumb Support 400

The thumb support or thumb piece 400 includes the base portion 410 and the thumb supporting portion 450. The base portion 410 includes the annular ring 412 and an upper interface portion 420. An inner surface 414 of the annular ring 412 includes a cylindrical throughbore 416 that defines a central longitudinal axis CLA of the thumb support 400. The annular ring 412 is sized to be snugly received on the middle region 354 of the rearward annular boss 350 of the frame body 310 when the handle assembly 200 is secured to the head assembly 300. When the thumb support 400 is mounted on the rearward annular boss 350, the central longitudinal axis CLA of the thumb support cylindrical throughbore 416 is substantially coincident with the handle assembly longitudinal axis LA.

A distal portion 415 of the inner surface 414 of the annular ring 412 includes a plurality of raised splines 418. The raised splines 418 of the annular ring 412 selectively interfit with mating raised splines 358 of the middle region 354 of the rearward annular boss 350 such that a rotational position of the thumb support 400 on the rearward annular boss 350 of the frame body 310 may be changed as desired. This can be seen by comparing, for example, FIGS. 3 and 13.

In FIG. 1, as viewed from above the power operated rotary knife 100, the thumb support 400 is positioned rotationally on the rearward annular boss 350 to the left of the handle assembly longitudinal axis LA. This position of the thumb supporting surface 454 would be suitable for right-handed use of the power operated rotary knife 100. By contrast, in FIG. 13, as viewed from above, the power operated rotary knife 100, the thumb support 400 is positioned rotationally on the rearward annular boss 350 to the right of the handle assembly longitudinal axis LA. This position of the thumb supporting surface 454 would be suitable for left-handed use of the power operated rotary knife 100. Further discussion relating to the thumb support 400 can be found in U.S. patent application Ser. No. 13/792,424 that was filed on Mar. 11, 2013 and entitled MOVEABLE THUMB SUPPORT ASSEMBLY FOR A POWER OPERATED ROTARY KNIFE, now issued as U.S. Pat. No. 9,321,183 to Steele et al. on Apr. 26, 2016. The MOVEABLE THUMB SUPPORT ASSEMBLY FOR A POWER OPERATED ROTARY KNIFE U.S. patent application is incorporated herein by reference in its entirety for all purposes.

Movable Lubrication Assembly 900

The moveable lubrication assembly 900, including rotatably disposed lubrication cup arrangement 500 is advantageously rotatable with respect to a stationary handle 200 position, providing a plurality of hand/operator orientations, including orientations suitable for left-handed and right-handed use of the power operated rotary knife 100, without the need for disassembly. Referring specifically to FIGS. 9-16, the design and interconnection of the moveable lubrication assembly 900 are further discussed.

The lubrication cup arrangement 500 includes the lubrication cup 502 coupled to the annular support 504 by way of spout shaft 910 that extends from a bottom 911 of the cup 502 into receiving shaft 912 projecting from the annular support. In the illustrated example embodiment of FIGS. 10, 11, and 16, the receiving shaft 912 includes a number of stepped annular orifices. The first annular orifice 914 receives a front portion 916 of the spout shaft 910, forming a thread connection (not shown) therein. Second 918 and third 920 annular orifices are concentric with the first annular orifice 914, radially located about a first lubrication axis, FLA. The first, second, and third orifices form a through opening 922 that extends into the annular support 504.

The lubrication cup 502 comprises a lubrication adapter or zerk 924 having a through passage P for receiving lubrication into a chamber 926 formed inside the cup. The chamber 926 stores or holds lubrication until selectively advanced to the gear train 602 through lubrication path 1000. The chamber 926 is defined at a lower end 932 by a housing 928 that extends and includes the spout shaft 910.

In the illustrated example embodiment, the housing 928 is made from metal but could be other materials such as plastic without departing from the spirit and scope of the disclosure. The chamber 932 is defined at an upper end 934 by an annular bulb 930, which includes an annular arm 936 retained within an annular recess 938 formed in an internal cavity 940 of the housing 928.

Figure 10:
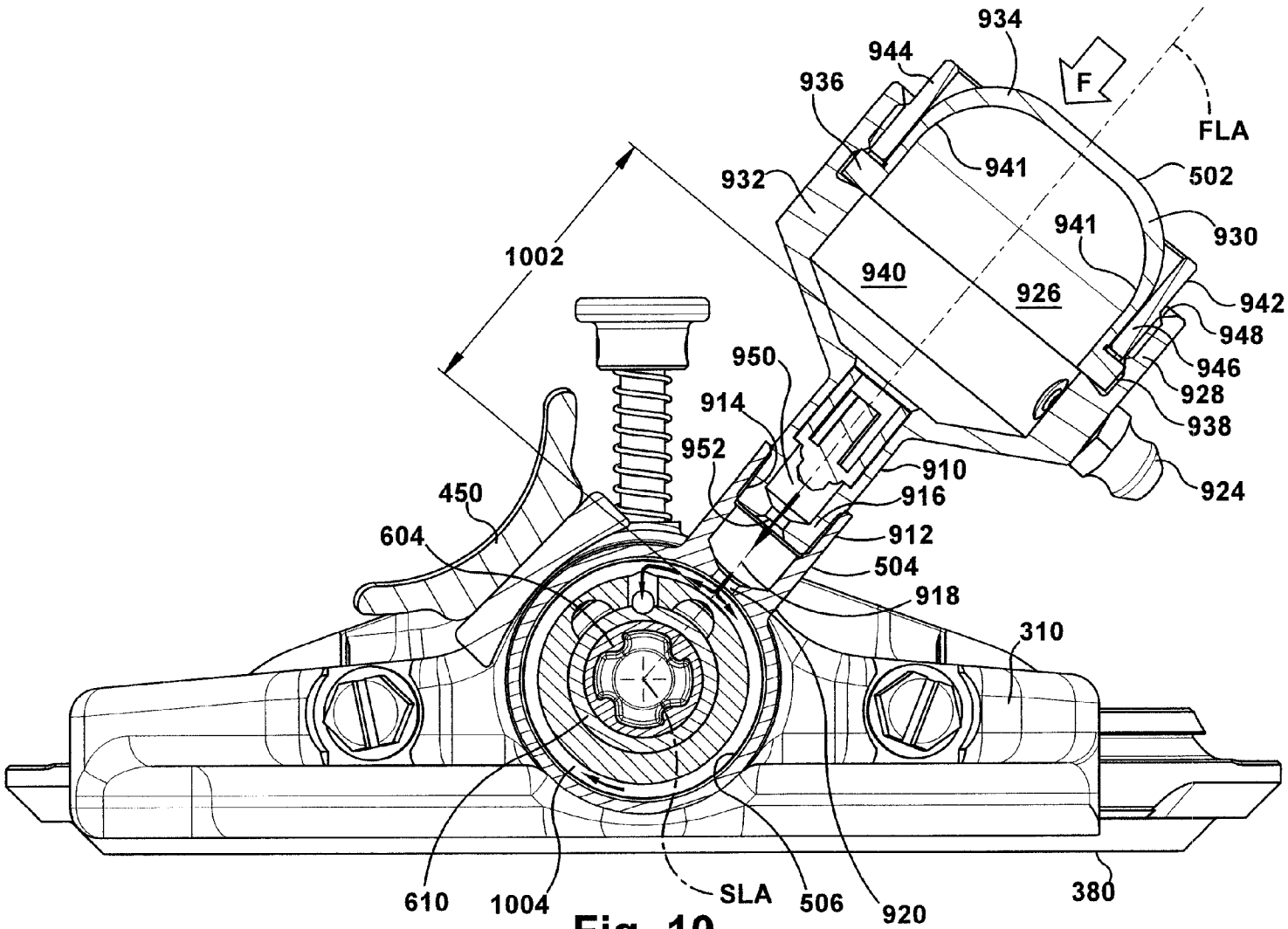
FIG. 10 is a schematic transverse sectional-view of FIG. 3 along section lines 10-10.
Figure 16:
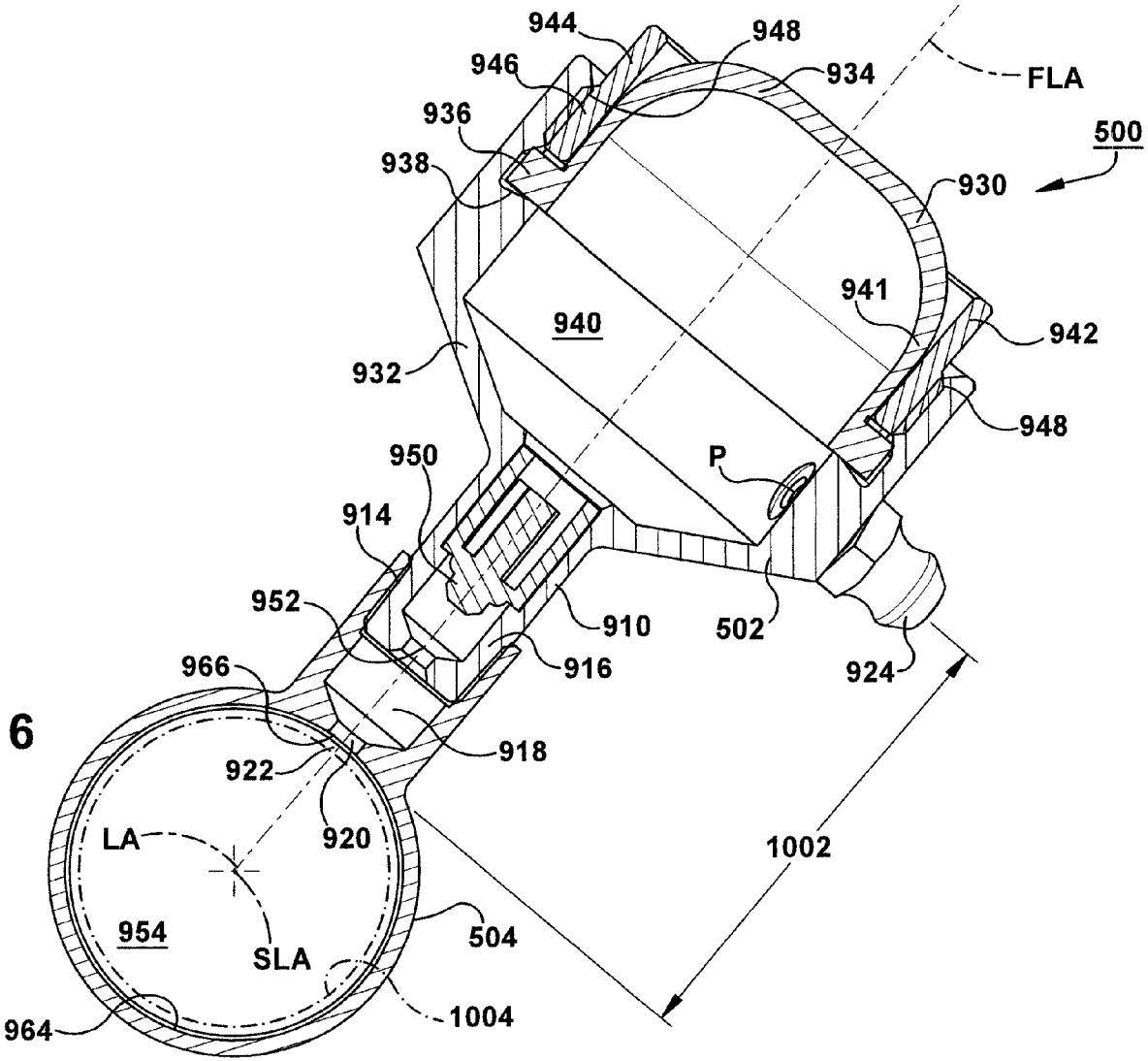
FIG. 16 is a schematic sectional view of the lubrication cup arrangement of FIG. 15 along section lines 16-16.
Figure 17:
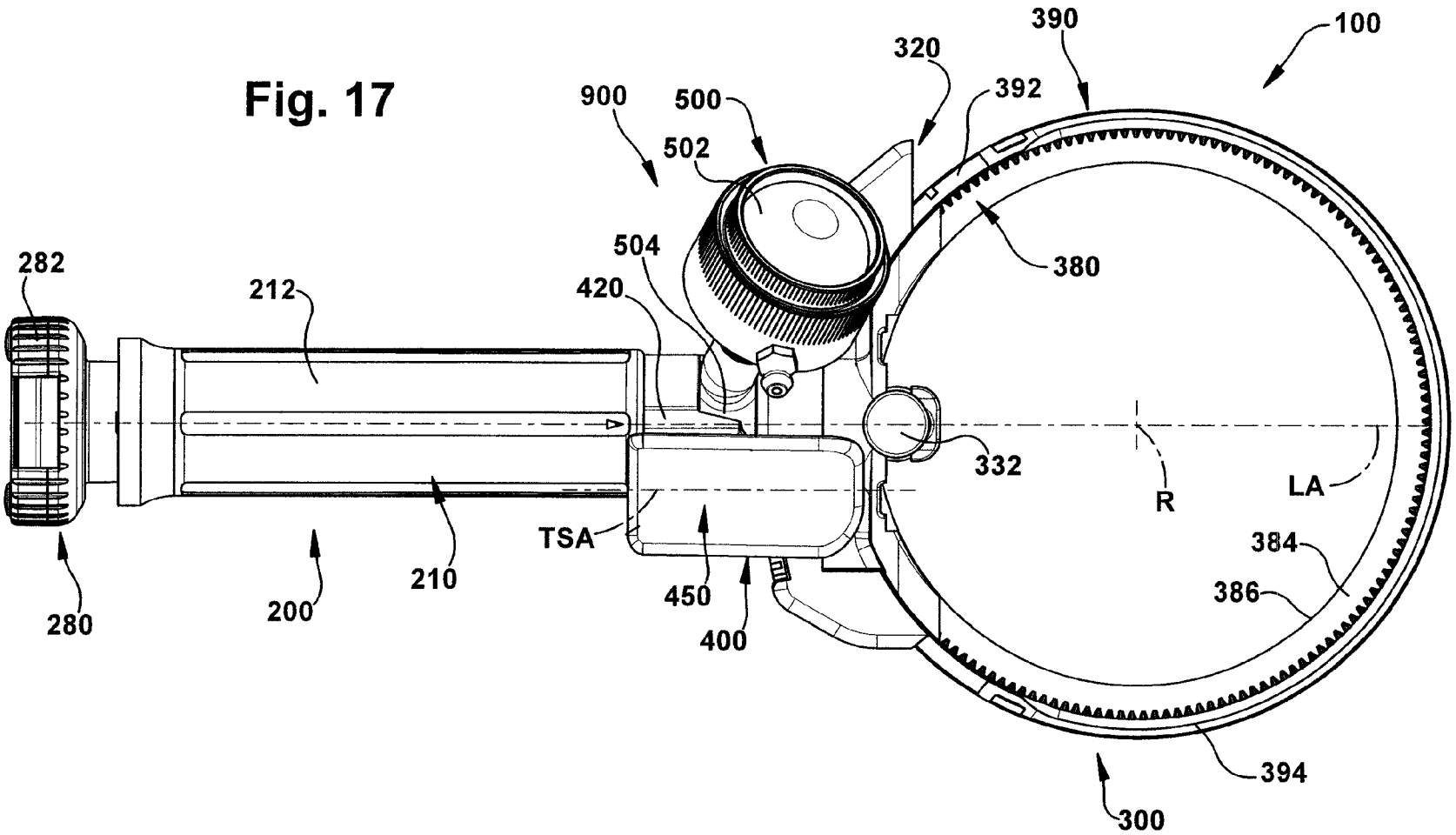
FIG. 17 is a schematic top plan view of the power operated rotary knife of FIG. 1 wherein the moveable lubrication assembly and thumb support are positioned on the head assembly at a rotational position suitable for a left-handed operator of the power operated rotary knife.
Figure 18:
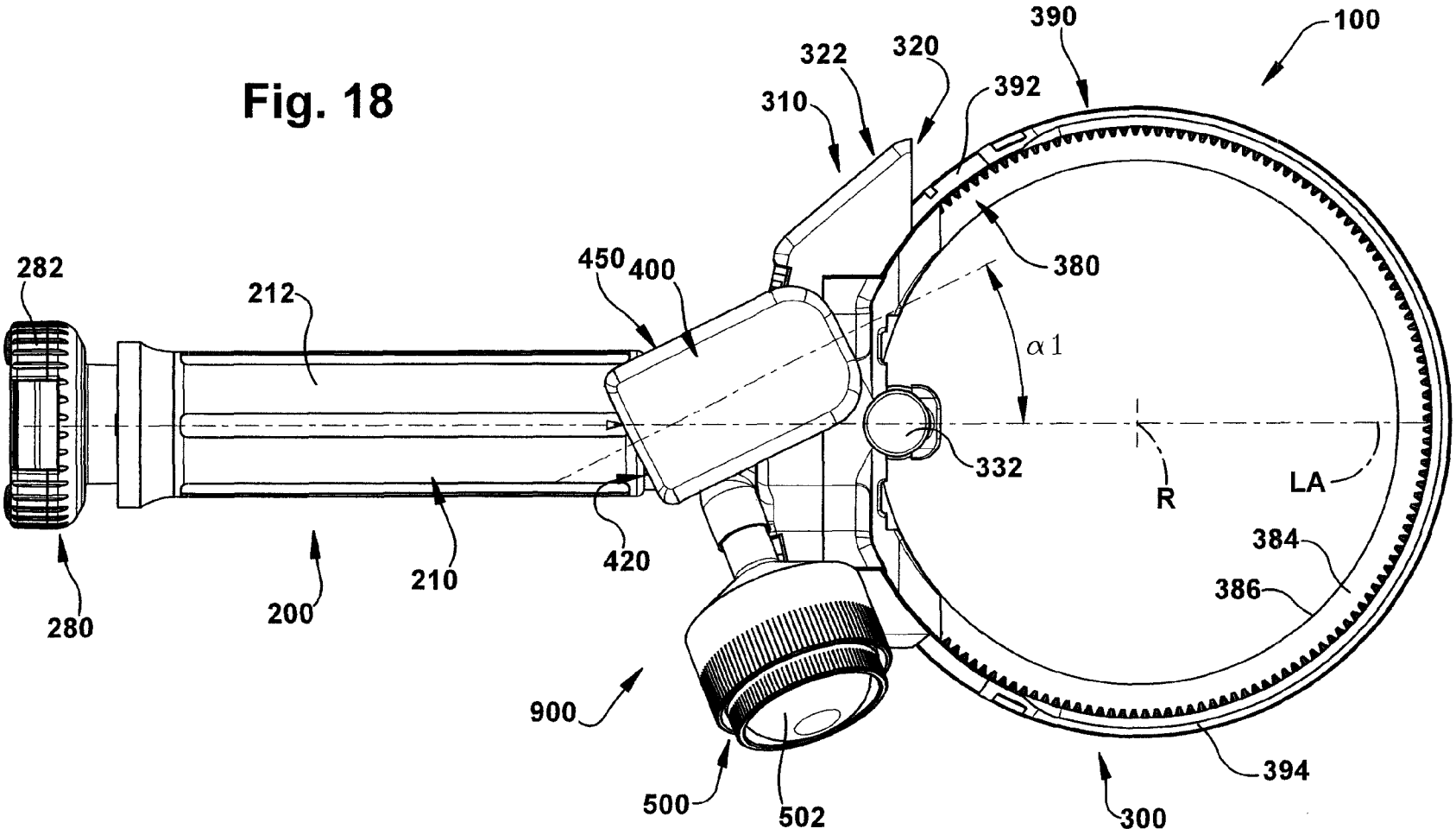
FIG. 18 is a schematic top plan perspective view of the power operated rotary knife of FIG. 1, the moveable lubrication assembly and pivoting thumb support are positioned on the head assembly at an upright rotational position suitable for a right-handed operator of the power operated rotary knife.
Figure 19:
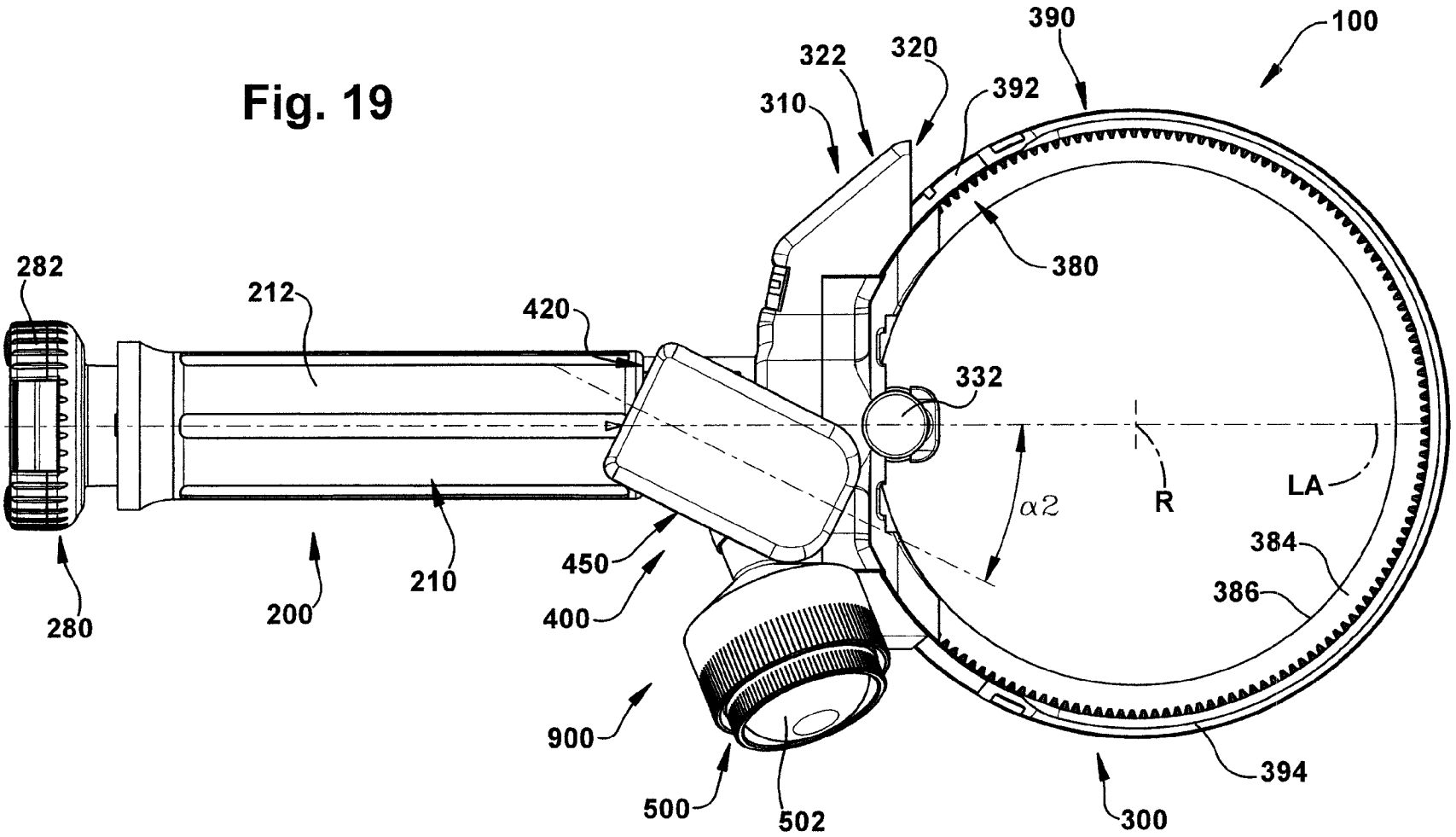
FIG. 19 is a is a schematic top plan view of the power operated rotary knife of FIG. 1, the moveable lubrication assembly and pivoting thumb support are positioned on the head assembly at an upright rotational position suitable for a left-handed operator of the power operated rotary knife.

In the illustrated example embodiment, the annular bulb 930 is formed from a low durometer plastic or soft rubber, pliable enough for the operator of the rotary knife 100 to elastically advance (without permanent deformation) the bulb inward in the direction of the arrow F, selectively advancing lubrication toward the drive train 602. Providing support and protecting the peripheral wall 941 of the bulb 930 is a circular cap 942. The circular cap 942 includes first and second diameters, 944 and 946, respectively, such that the second diameter 946 is greater than the first diameter. The housing 928 includes a threaded connection beginning at an annular ridge 948 for retaining the cap 942, engaging the first threaded diameter 944 and continuing along the threaded body 946, thus preventing removal of the cap from the cavity 940 without loosening the threaded connection, as illustrated in FIGS. 10 and 16.

Axially aligned with first, second, and third orifices, 914, 918, and 920 are first and second annular passages 950, 952, respectively that extend from the chamber through the spout shaft 910 and orifices, and into the through opening 922 of the annular support 504. The first and second annular passages 950, 952 and orifices, 914, 918, and 920 form a first portion 1002 of the lubrication path 1000.

Figure 13:
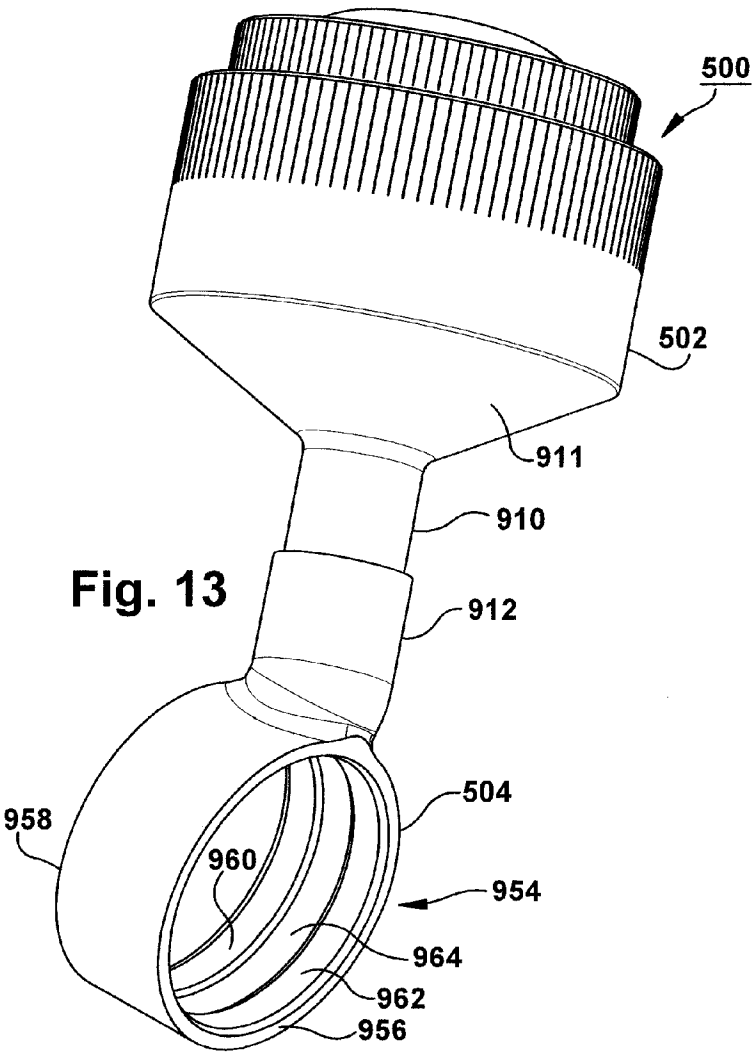
FIG. 13 is a schematic lower perspective view of a lubrication cup arrangement constructed in accordance with one example embodiment of the present disclosure.
Figure 12:
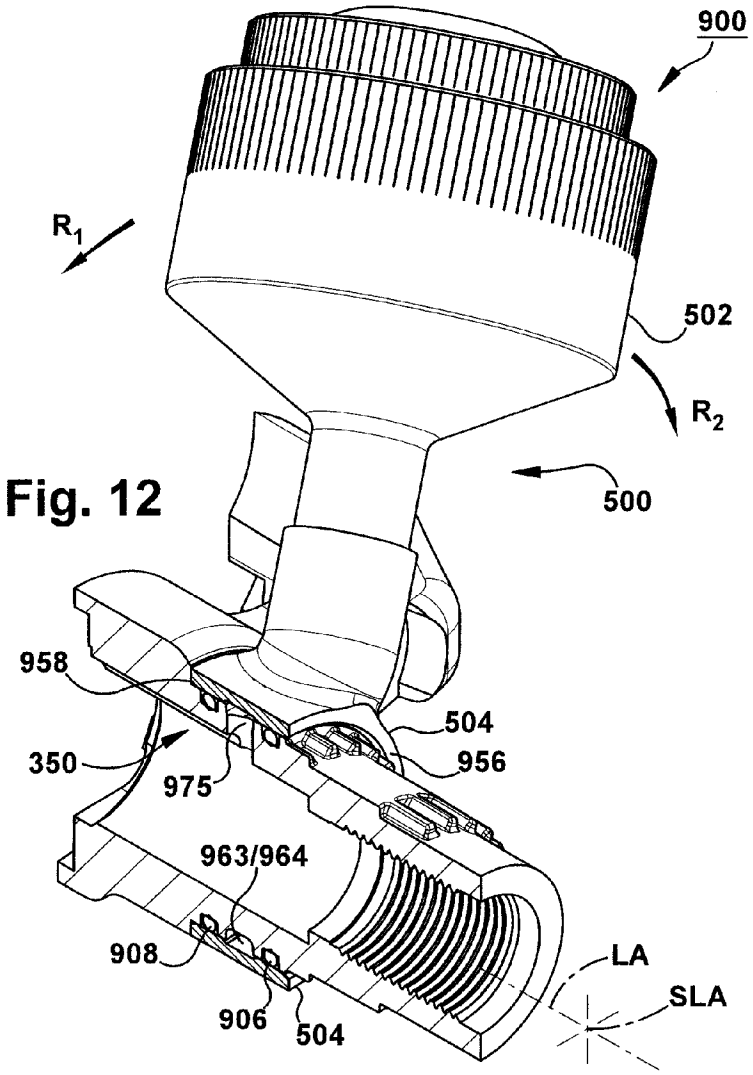
FIG. 12 is a schematic partial perspective sectional-view of FIG. 3 along a portion of the longitudinal axis LA of the head and moveable lubrication assemblies, as shown by section lines 12-12.
Figure 15:
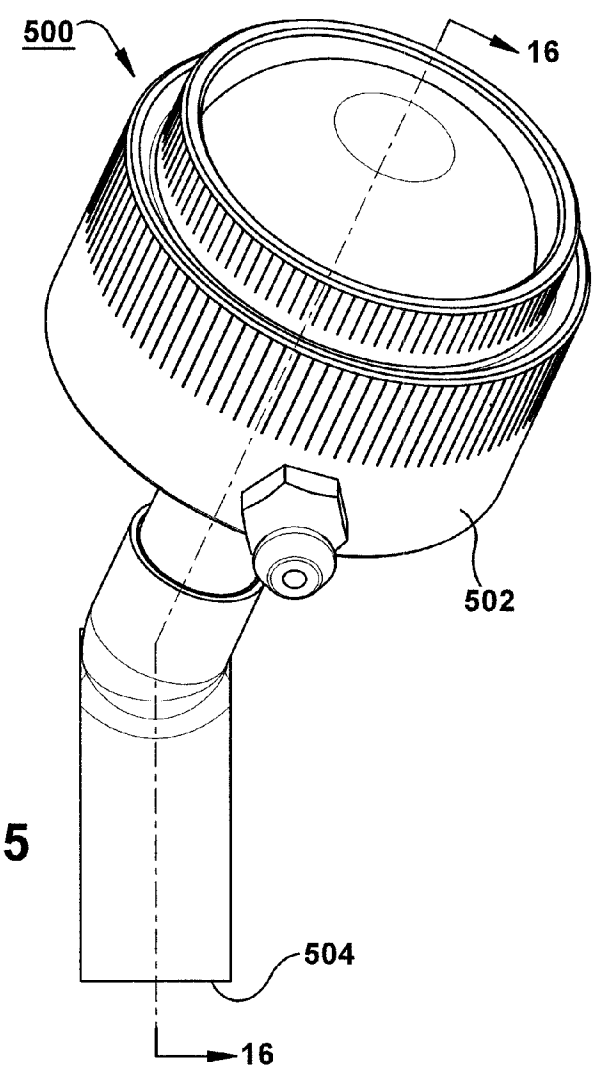
FIG. 15 is a schematic upper perspective view of a lubrication cup arrangement of FIG. 13.
Figure 14:
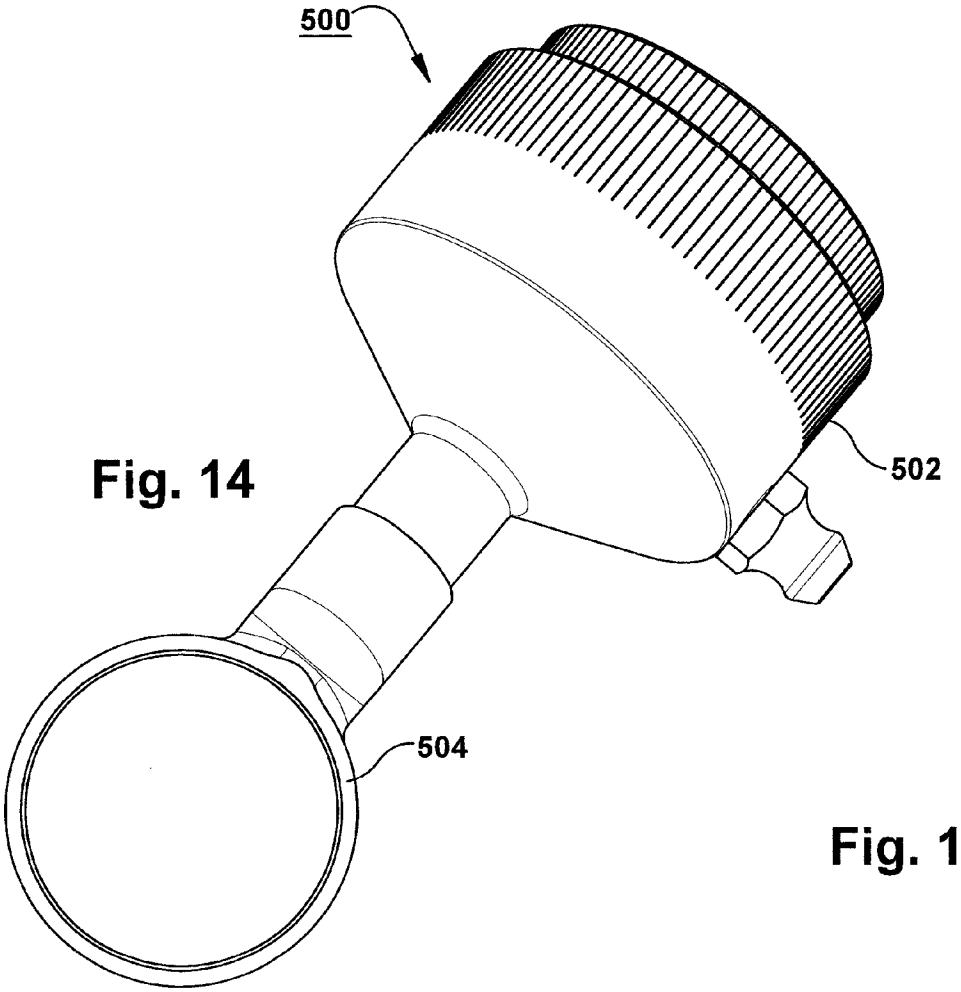
FIG. 14 is a schematic elevation view of the lubrication cup arrangement of FIG. 13.

The annular support 504 includes a circular through chamber 954 having first and second ends, 956, 958, respectively, as best seen in FIG. 13. Located within the chamber 954 are first and second annular grooves 960, 962, surrounding centrally disposed lubrication circular passage channel 964 that forms one-half of an annular lubrication track 975. The third annular orifice 920 passes and forms a lubrication opening 966 in the circular passage channel 964.

During assembly, the circular through chamber 954 is disposed over the rearward annular boss 350 until the second end 958 engages planer wall 968 such that first and second exterior grooves 902, 904 of the boss align with first and second grooves 960, 962 within the chamber to support respective seals 906, 908 and a central lubrication path 963, forming the other half of the annular lubrication track 975 when aligned with the circular lubrication passage channel 964. A base portion 410 of the thumb support 450 secures the moveable location assembly 900 to the rotary knife 100, between the thumb support and planer wall 968. The thumb support 405 is secured to the head assembly 300 via slip rings, splines, screws, or any combination thereof and as further discussed in the U.S. patent application Ser. No. 13/792,424, which is incorporated herein by reference in its entirety.

In one example embodiment, the seals 906 and 908 are a-rings. In another example embodiment, the seals 906, 908 are nitrile gasket material. The seals 906 and 908 contain all lubrication within the annular lubrication track 975 formed by the lubrication circular passage channel 964 and central lubrication channel 963, prohibiting any lubrication from moving in either direction along the longitudinal axis LA.

The seals 906, 908 containment of the lubrication within the annular lubrication track 975 radially forms a second portion 1004 of the lubrication path 1000 about a second lubrication axis SLA, as best illustrated in FIGS. 13 and 16. It should be appreciated that as the lubrication cup 504 is depressed in the direction of force F in FIG. 10, the lubrication advances from the cavity 940 along the first portion 1002 of the lubrication path to the second portion 1004 of the lubrication path around and within the perimeter of the central lubrication path 963 and circular lubrication passage channel 964.

Positioned within the central throughbore 312 is the gear train 602 that includes the pinion gear coupled to the pinion shaft 970. The pinion shaft 970 is rotatably disposed within the bushing 610. The bushing 610 comprises an elongated slot 972 that includes a through opening 973 that passes to the pinion shaft 970. When assembled, the slot 972 and a through bushing opening 973 align under lubrication aperture 974 of the central lubrication path 963.

Figure 11:
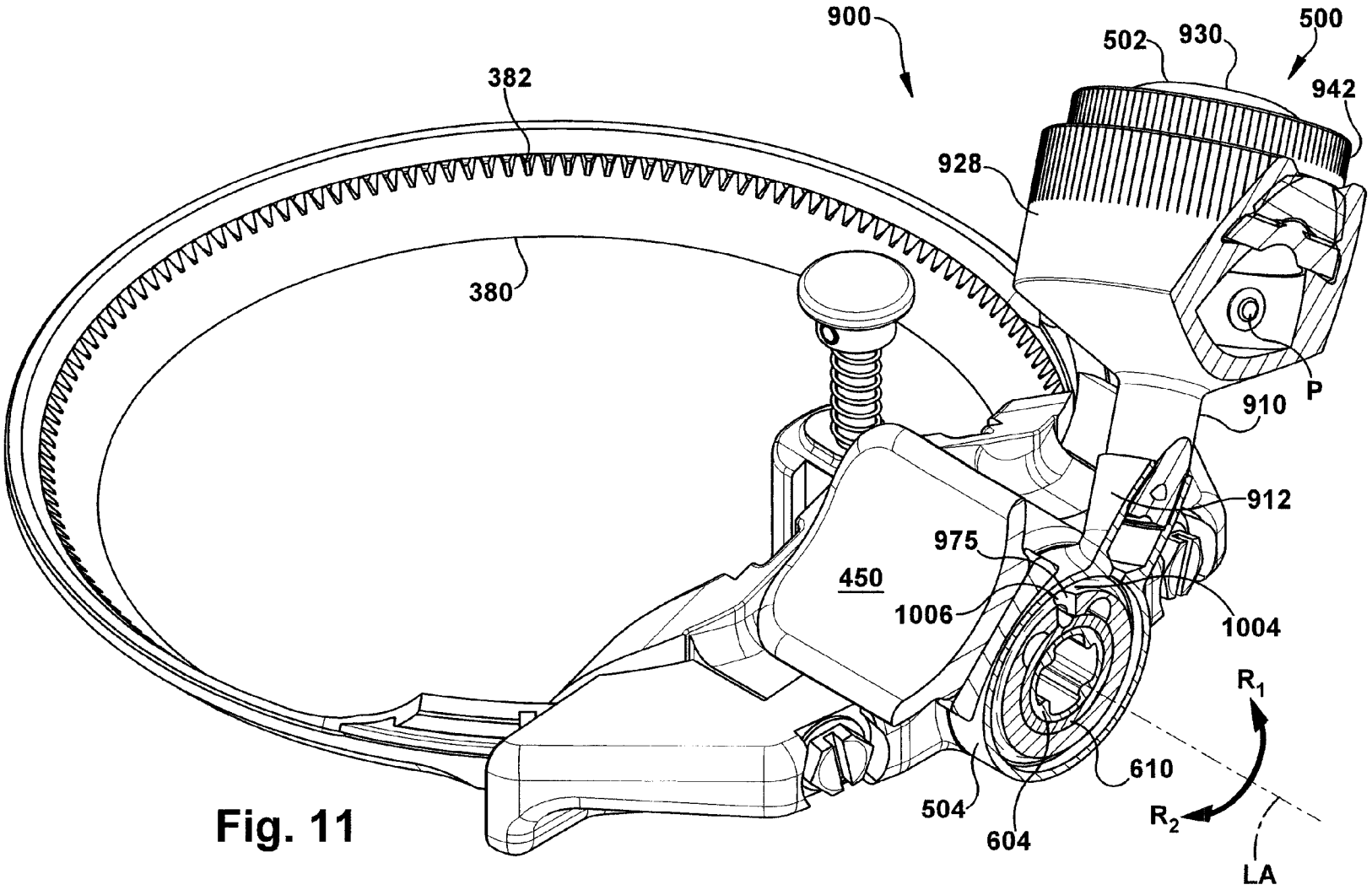
FIG. 11 is a schematic perspective transverse sectional-view of FIG. 3 along section lines 11-11.

The central lubrication path 963 and passage channel 964 collectively form the annular lubrication track 975 when the annular support 504 is disposed over the boss 350. The passage of the lubrication from the annular lubrication track 975 through the lubrication aperture 974 into the slot 972 and bushing opening 973 to form a third portion 1006 of the lubrication path 1000, as best illustrated in FIG. 11. Passage of the lubrication from the slot 972 into the bushing opening 973 provides lubrication to the pinion shaft 970 as it rotates within the bushing 610. It should be appreciated that as the lubrication cup 504 is depressed in the direction of force F in FIG. 10, the lubrication advances from the cavity 940 along the first portion 1002 of the lubrication path to the second portion 1004 of the lubrication path and into the third portion of the lubrication path 1006.

A fourth portion 1008 of the lubrication path 1000 is formed by the passage of a portion of the lubrication along the slot 972 toward and onto the pinion gear head 606. Such passage advantageously provides lubrication to both the gear head 606 and gear teeth 382. It should be appreciated that as the lubrication cup 504 is depressed in the direction of force F in FIG. 10, the lubrication advances from the cavity 940 along the first portion 1002 of the lubrication path to the second portion 1004 of the lubrication path and into the third and fourth portions of the lubrication path, 1006 and 1008, respectively. In one example embodiment, the lubrication cup 502 and cavity 940 therein has at least three times the lubrication volume as the volume of lubrication in the sum total of the first through the fourth lubrication portions paths 1002, 1004, 1006, and 1008.

Figure 9A:
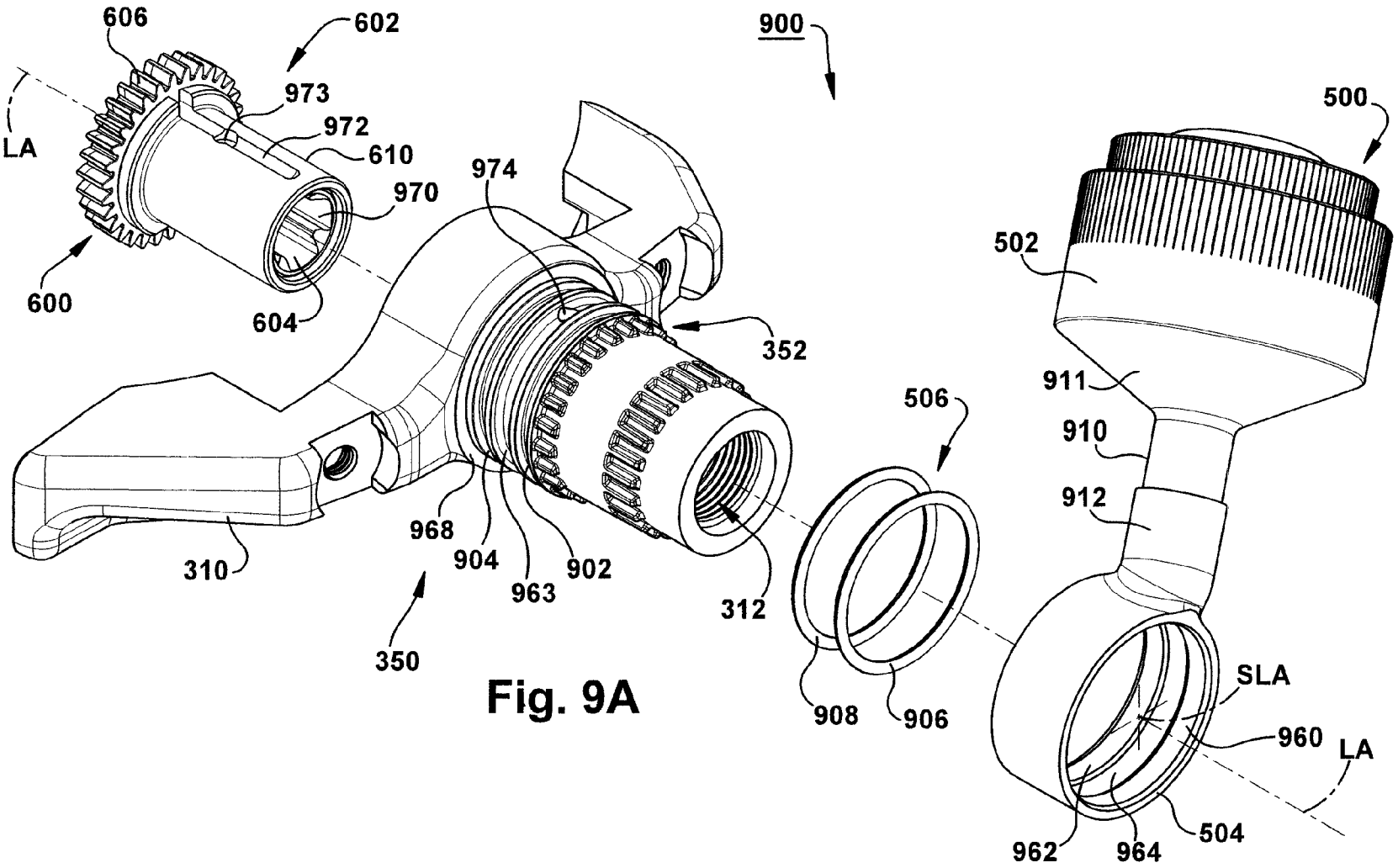
FIG. 9A is a schematic exploded perspective view of a moveable lubrication assembly for the power operated rotary knife of FIG. 1 constructed in accordance with one example embodiment of the present disclosure.

During operation, the moveable lubrication assembly 900 can advantageously be rotated about the boss 350 relative to the handle assembly 200 to accommodate any desired location personalized by the operator during use without the need for tools. As illustrated in FIG. 9A, the lubrication assembly can be rotated endlessly counter-clockwise in the direction of R1 or rotated endlessly clockwise in the direction of R2. The annular support 504 rotates about the boss 350 without interruption to lubrication paths 1002, 1004, 1006, and 1008. In another example embodiment, the lubrication assembly 900 and thumb support endlessly rotate around the boss 350 in either a clockwise or counter-clockwise direction. As the rotation of the moveable lubrication assembly 900 occurs, the lubrication is retained in the annular lubrication track 975, for selective advancement by the user.

Figure 9B:
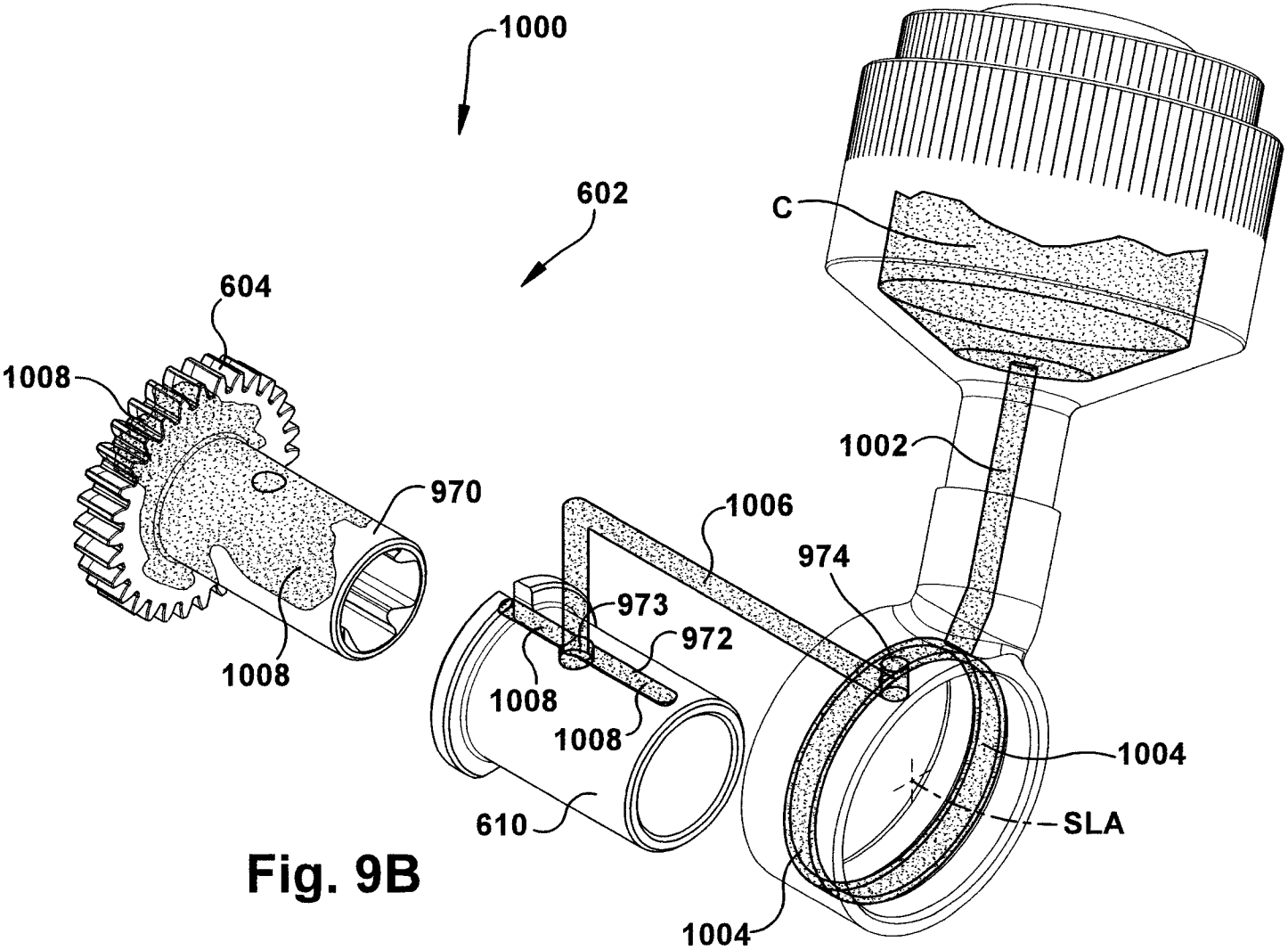
FIG. 9B is a schematic exploded view of a portion of a gear train and lubrication flow paths in accordance with one example embodiment of the present disclosure.

Illustrated in FIG. 9B is an exploded view of the gear train 602, and more specifically, the lubrication path 1000 as it passes from the chamber 926 of the cup arrangement indicated by reference character "C" to the pinion gear 604, through portions 1002, 1004, 1006, and 1008. As can be appreciated by the exploded view of FIG. 9B, the second portion 1008 of the lubrication path 1000 provides lubrication to both the pinion shaft 970 within the bushing 610 and to the gear head 604.

As used herein, terms of orientation include upper, lower, inward, outward, etc., figures or drawings. Such orientation terms are not intended to limit the scope of the present disclosure or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A power operated rotary knife comprising: a handle assembly extending along a longitudinal axis, a head assembly affixed to and extending from the handle assembly, the head assembly including a frame body and supporting an annular rotary knife blade, the frame body extending between the handle assembly and the annular rotary knife blade, a drive mechanism supported by the head assembly and comprising a pinion gear, the drive mechanism rotating said annular rotary knife blade; and a lubrication assembly mounted on the frame body, the lubrication assembly including a lubrication cup coupled to an annular support, the lubrication cup including a chamber within the lubrication cup for holding lubrication, the annular support rotatably mounted on the frame body and including an inner surface defining a through chamber extending between first and second ends of the annular support, the frame body extending through the annular support through chamber, the lubrication assembly being rotatable relative to the frame body and the handle assembly about the longitudinal axis of said handle assembly and the chamber of the lubrication cup being in fluid communication with the annular support thereby providing a lubrication path extending from the chamber of the lubrication cup to the inner surface of the annular support.

2. The power operated rotary knife of claim 1 wherein the inner surface of the annular support of the lubrication assembly includes an annular lubrication passage channel, forming a portion of the lubrication path.

3. The power operated rotary knife of claim 2 wherein the inner surface of the annular support of the lubrication assembly includes a pair of annular grooves disposed at opposite ends of the annular lubrication passage channel.

4. The power operated rotary knife of claim 1 wherein the lubrication assembly further includes a spout shaft extending from a bottom of the lubrication cup to a receiving shaft projecting from the annular support.

5. The power operated rotary knife of claim 4 wherein the spout shaft includes an orifice forming a portion of the lubrication path.

6. The power operated rotary knife of claim 4 wherein the receiving shaft of the annular support includes a plurality of stepped annular orifices forming a portion of the lubrication path, the plurality of stepped annular orifices forming a through opening forming a portion of the lubrication path extending to the inner surface of the annular support.

7. The power operated rotary knife of claim 1 wherein the frame body includes a boss extending rearwardly toward the handle assembly along the handle assembly longitudinal axis and the annular support of the lubrication assembly is mounted on the boss of the frame body.

8. The power operated rotary knife of claim 7 wherein an exterior surface of the boss of the frame body includes a planar wall and spaced apart first and second annular exterior grooves, first and second seals being received in the first and second annular exterior grooves, respectively, and wherein the second end of the annular support of the lubrication assembly engages the planar wall of the boss of the frame body.

9. The power operated rotary knife of claim 8 wherein the exterior surface of the boss of the frame body between the first and second annular exterior grooves includes an annular central lubrication channel which is aligned with the annular lubrication passage channel of the inner surface of the annular support.

10. A power operated rotary knife comprising:

a handle assembly extending along a longitudinal axis;

a head assembly affixed to and extending from the handle assembly, the head assembly including a blade housing for rotatably supporting an annular rotary knife blade and a frame body including a forward blade housing support region supporting the blade housing and a rearward annular boss;

a drive mechanism supported by the head assembly comprising a pinion gear, the drive mechanism being operatively coupled to rotate the annular rotary knife blade; and a movable lubrication assembly including a lubrication cup having a chamber within the lubrication cup for holding lubrication and an annular support rotatably mounted on the rearward annular boss of the frame body and including an inner surface defining a through chamber extending between first and second ends of the annular support, the frame body annular boss extending through the annular support through chamber, the lubrication assembly being rotatable relative to the frame body and the handle assembly about the longitudinal axis of the handle assembly and the chamber of the lubrication cup being in fluid communication with the annular support thereby providing a lubrication path from the chamber of the lubrication cup to the inner surface of the annular support.

11. The power operated rotary knife of claim 10 wherein the inner surface of the annular support of the lubrication assembly includes an annular lubrication passage channel, forming a portion of the lubrication path.

12. The power operated rotary knife of claim 11 wherein the inner surface of the annular support of the lubrication assembly includes a pair of annular grooves disposed at opposite ends of the annular lubrication passage channel.

13. The power operated rotary knife of claim 10 wherein the lubrication assembly further includes a spout shaft extending from a bottom of the lubrication cup to a receiving shaft projecting from the annular support.

14. The power operated rotary knife of claim 13 wherein the spout shaft includes an orifice forming a portion of the lubrication path.

15. The power operated rotary knife of claim 13 wherein the receiving shaft of the annular support includes a plurality of stepped annular orifices forming a portion of the lubrication path, the plurality of stepped annular orifices forming a through opening forming a portion of the lubrication path extending to the inner surface of the annular support.

16. The power operated rotary knife of claim 10 wherein an exterior surface of the boss of the frame body includes a planar wall and spaced apart first and second annular exterior grooves, first and second seals being received in the first and second annular exterior grooves, respectively, and wherein the second end of the annular support of the lubrication assembly engages the planar wall of the boss of the frame body.

17. The power operated rotary knife of claim 16 wherein the exterior surface of the boss of the frame body between the first and second annular exterior grooves includes an annular central lubrication channel which is aligned with the annular lubrication passage channel of the inner surface of the annular support.

18. A lubrication assembly rotatably mounted to an annular boss of a frame body of a power operated rotary knife, the lubrication assembly being rotatable about the annular boss of the frame body and a longitudinal axis of a handle assembly extending from the frame body and providing a lubrication path from a lubrication cup of the lubrication assembly to a drive mechanism of the power operated rotary knife, the lubrication assembly comprising:

the lubrication cup including a chamber within the lubrication cup for holding lubrication routed along the lubrication path;

an annular support including a receiving shaft and an inner surface defining a through chamber extending between first and second ends of the annular support, the inner surface of the annular support defining an annular lubrication passage channel, forming a portion of the lubrication path and the receiving shaft including an orifice for routing lubrication to the annular lubrication passage channel; and a spout shaft extending from a bottom of the lubrication cup to the receiving shaft projecting from the annular support for routing lubrication from the lubrication cup to the orifice of the receiving shaft of the annular support.

19. The lubrication assembly of claim 18 wherein the orifice of the receiving shaft of the annular support comprises a plurality of stepped annular orifices forming a portion of the lubrication path, the plurality of stepped annular orifices defining a through opening forming a portion of the lubrication path extending to the inner surface of the annular support.

* * * * *